United States Patent [19]

Custin

[11] 4,452,064

[45] Jun. 5, 1984

[54] CONDUIT BENDER WITH BEND ANGLE INDICATORS

[75] Inventor: James R. Custin, Elm Grove, Wis.

[73] Assignee: Gardner Bender, Inc., Milwaukee, Wis.

[21] Appl. No.: 445,225

[22] Filed: Nov. 29, 1982

[51] Int. Cl.[3] ..... B21D 7/14

[52] U.S. Cl. ..... 72/459

[58] Field of Search ..... 72/458, 459, 457, 31, 72/310

[56] References Cited

U.S. PATENT DOCUMENTS 2,233,292 2/1941 Lewin ..... 72/459

4,052,881 10/1977 Mount ..... 72/459

*Primary Examiner*—Daniel C. Crane

*Assistant Examiner*—David B. Jones

*Attorney, Agent, or Firm*—James E. Nilles; James R. Custin

[57] ABSTRACT

A tube bender comprising a body having an upwardly opening hook at a front end thereof and having a bottom surface defined by a convexly arcuate bending shoe extending rearwardly from the hook has movable indicators, one for each of a plurality of bend angles, each of which rises to a signalling position when a tube being bent attains its bend angle. Each indicator has a pin-like shank slidable in a bore in the body that opens to the bottom surface near the vertical plane of symmetry of the shoe and at a location where a tube being bent contacts that surface upon attaining the bend angle for the indicator. A head on the indicator normally rests on an upwardly facing surface on the body to which the bore opens upwardly, with the shank projecting below said bottom surface. The head comes flush with an upwardly facing signalling surface on the body when the bend angle is attained.

6 Claims, 12 Drawing Figures

CONDUIT BENDER WITH BEND ANGLE INDICATORS

FIELD OF THE INVENTION

This invention relates to tools for bending pipes, tubes, electrical conduit and similar workpieces, and the invention is more particularly concerned with a bending tool having means for indicating, as the tool is being used, the angle to which a workpiece has been bent.

BACKGROUND OF THE PRIOR ART

Tools for bending tubes, pipes and conduits are of a well-known type, usually comprising a one-piece body that has an elongated, downwardly grooved arcuate shoe at its bottom, a hook at its front, and an upwardly projecting handle socket in which a handle is removably receivable. The hook is engaged under a length of tubing or the like to be bent, which is held down against a floor or other supporting surface, and bending force exerted upon the handle, transmitted to the tube by means of the hook, curves the tube around the shoe.

With most such tools heretofore available, there was no way of directly determining, during use of the tool, the angle of bend that had been imparted to the workpiece being bent. Usually, therefore, the user had to terminate the bending operation when he estimated that the desired bend angle had been achieved, then measure the actual bend angle, and then often as not make one or more further bends and measurements until the desired angle had been obtained, sometimes also finding it necessary to unbend the workpiece to some extent.

U.S. Pat. No. 2,953,048, issued to J. A. Brown in 1960, disclosed an angle readout device in the form of an accessory for attachment to a bending tool. This was one of several prior attempts to solve the problem to which the present invention is directed, and, like the others, it had marked deficiencies. The device of the Brown patent was detachably secured to the removable handle of the bending tool by means of a clamp that was installed on the handle at a distance above its socket on the tool body. The clamp supported a medially pivoted lever that was swingable relative to the handle and also supported a dial that it held stationary on the handle. One arm of the lever served as a pointer that cooperated with the dial, and the opposite arm terminated in a follower that rested on the tube to be bent, at a location some distance to the rear of the tool body. As the handle of the tool was swung during a tube bending operation, the dial moved with the handle and relative to the lever to provide indications of bend angle. Accuracy of the device was dependent upon accurate location of its clamp both lengthwise and rotationally along the handle, since the location of the lever pivot determined the angle of the follower lever in any given position of the handle. Installing and adjusting the device was thus likely to take more time than could be saved by its use in making a few bends, so that it was actually inefficient for many jobs. Obviously it was not easy to read the indications on the dial as it moved with the swinging handle; hence use of the device tended to slow the tube bending operation to some extent. In addition, the long, freely swingable follower lever made the tool awkward to carry and complicated the engagement of the tool proper with tubing to be bent.

An earlier (1954) U.S. patent to J. W. Lewin, U.S. Pat. No. 2,666,351, had disclosed a somewhat similar angle indicating attachment for a tube bender, likewise intended to be attached to the handle for the tool. Lewin's device comprised a stop arm that was intended to be locked in any one of a number of designated angle positions and to strike the floor or other supporting surface when a tube bend had attained the angle for which the arm was adjusted. Although less cumbersome than the device of the above-discussed Brown patent, that of the Lewin patent was nevertheless far from compact, and it had the further disadvantage of needing adjustment each time a different angle was to be bent.

U.S. Pat. No. 3,718,018, issued in 1973 to J. D. Benfield, disclosed a bending tool having a step-like series of upper surfaces that were disposed at acute angles to one another, each bearing an indication of bend angle. The tool was operated in the conventional manner, and to produce a bend of a desired angle the handle of the tool was swung until the surface marked with the desired angle of bend was brought to a horizontal orientation. This development was obviously not very satisfactory in actual use because of the extreme difficulty of judging the point at which a relatively small surface, viewed from above, has swung to an exactly horizontal attitude; but the patent demonstrates that the art was seeking a compact bend angle indicator that was not likely to be bent or broken under the high forces imposed upon a bending tool both in its use and in other handling.

To avoid the need for judging the attitude of the tube bender body relative to horizontal, U.S. Pat. No. 4,052,881, issued in 1977 to R. W. Mount, disclosed a glass tube that was arcuately curved along its length and was mounted on an upwardly facing surface on the bender body, and a pair of balls that rolled along inside the tube to remain at its lowest point and cooperate with calibrations along the tube for designating the angle of bend that had been achieved. Of course the device was not accurate if it was used on a supporting surface that was tilted out of horizontal. Disadvantages that were perhaps more important were high cost and the fragility of the glass tube in relation to the treatment that a bending tool is likely to receive.

A generally similar solution to the problem, with similar deficiencies, is presented by certain commercially available tube benders wherein two spirit levels are mounted on the tool body, at an angle to one another, each oriented to center its bubble when a predetermined bend angle is reached.

A tube bender having an integral angle indicating device is disclosed in U.S. Pat. No. 4,009,602, issued in 1977 to W. A. Linquist. The tube bender of that patent has enjoyed some commercial success, probably because its angle indicating means is sturdy, compact, and accurate enough to be helpful. It comprises small protuberances formed integrally with the body of the bending tool and projecting to one side of the body near the front of it. One of these protuberances, which can be regarded as an upper sighting element, is formed on a reinforcing web that extends forwardly to connect the handle supporting portion of the body with the hook on the front end of the body. Several more such protuberances are formed at intervals along the arcuate shoe at the bottom of the body, to provide lower sighting elements, and there is one more such lower sighting element on the handle supporting portion, intermediate its top end and the shoe. In use, a desired angle of bend is assumed to be achieved when the upper sighting element comes into alignment with a selected one of the lower sighting elements, each of which corresponds to a desired bend angle. A major disadvantage of this indicating device is that the indicated angle of bend will not be the actual angle achieved unless the user's eye is on a line through the upper sighting element that is perpendicular to the surface which supports the tube being bent, and the attainment of this perpendicular relationship has to be estimated by the user.

A tube bender having a substantially better integral bend angle indicating means is disclosed in the copending U.S. application of William E. Gardner, Ser. No. 419,802, filed Sept. 20, 1982. The assignee of the present application makes and sells, under license, tube benders embodying the invention of that Gardner application. Such a tube bender has a group of ridges that are formed integrally with its body at each side thereof, each group defining a plurality of sighting lines that diverge downwardly from a point on the handle supporting portion of the body and each sighting line corresponding to a designated bend angle. In using the tool, a conduit is bent until the sighting line corresponding to the desired bend angle is judged to be perpendicular to the floor or other surface that supports the conduit.

Use of the Gardner tube bender thus involves the same basic problem of estimating perpendicularity that is involved in using the bender of the Linquist patent. The user of such a tool is handicapped in making this estimate because he is looking down along the sighting line that must be brought to the perpendicular orientation, hence he does not have the advantage of being off to one side of that line where he could more easily judge the angles that it makes with the floor. Furthermore, an accurate estimate of the perpendicular relationship becomes very difficult when the bending tool is used on a surface that is tilted out of horizontal or is used near inclined articles that can give rise to optical illusions.

It will be apparent from this brief survey of the prior art that the provision of a completely satisfactory bend angle indicator for a tube bending tool has defied not only ordinary skill in the art but also several exercises of inventive ingenuity.

SUMMARY OF THE INVENTION

A general object of the present invention is to provide a tool for bending tubing, pipes, conduit and similar workpieces, having a body which is formed in one piece, as is generally conventional, and which is arranged for cooperation with very simple indicators that afford a clear and direct visual indication to the user when each of a plurality of predetermined bend angles has been imparted to a length of tubing being bent by the tool, without calling upon the user to make any estimate or judgment concerning the attitude of the tool.

Another general object of the present invention is to provide a bending tool of the character described that has a one-piece body which carries movable bend angle indicators, wherein each indicator designates one of a plurality of commonly used angles to which tubing or conduit can be bent and moves to a predetermined and readily discernable position when a workpiece being bent has been brought to that bend angle, and whereby the designated bend angles are accurately indicated irrespective of the attitude of the surface on which the workpiece is supported.

Another and more specific object of the invention is to provide a bending tool of the character described that comprises a one-piece body which has a lower portion formed as a bending shoe and which carries movable indicators, one for each of a plurality of predetermined bend angles and each of which provides a distinct visible indication when a workpiece being bent has arrived at its bend angle, and wherein the indicators provide very accurate indications because each indicator is directly actuated by the portion of the workpiece that comes into engagement with the bending shoe as the workpiece is brought to the bend angle for the indicator.

It is a further specific object of the invention, in one embodiment thereof, to provide an inexpensive bending tool that has a body which is formed in one piece and which has integral provisions for cooperation with common nails that serve as bend angle indicators of the above described character.

Another specific object of the invention, attained in another embodiment of it, is to provide a bending tool having a plurality of bend angle indicators, one for each of a plurality of predetermined bend angles, wherein each of the indicators is movable in a one-piece body of the tool, to and from a position in which the indicator clearly signals that its bend angle has been attained, and wherein each of the indicators is captivated by the body and is well protected by the body from injury and deformation due to rough handling of the tool.

It is also a specific object of this invention to provide a tube bender having movable indicators for visibly signalling the attainment of each of a plurality of predetermined bend angles and having one such indicator for each such bend angle, wherein the indicators are so arranged that each comes directly into the natural line of vision of the user of the tool as conduit being bent approaches the bend angle signified by the indicator, so that the user can readily see the signal which denotes that a desired bend angle has been achieved, and so that the indicators can all be alike, for production economy, notwithstanding that they designate different bend angles.

These and other objects of the invention that will appear as the description proceeds are achieved in a bending tool that is conventional insofar as it comprises an elongated body that can be made in one piece, having a conduit engaging hook at a front end thereof, having a convexly arcuate bottom surface against which conduit engaged by said hook is forced upward for bending and which is defined by a downwardly opening groove that extends rearwardly from said hook and is from side to side symmetrical to an upright plane of symmetry, and having an upwardly projecting handle supporting portion that has its axis contained in said plane. The bending tool of this invention is characterized by said body having therein at least one bore that opens upwardly to a first substantially upwardly facing surface on the body and opens downwardly to said bottom surface near said plane and at a location where conduit being bent by the tool comes into engagement with said bottom surface when it has been bent to a predetermined angle, said bore and said first surface being cooperable with an indicator that has a pin-like shank which is longer than said bore and is slidably receivable therein and has an enlarged head on an upper end of said shank which can rest on said first surface to support the indicator with a lower end portion of its shank projecting below said bottom surface; and said body having thereon a second substantially upwardly facing surface which is so spaced radially from the axis of the bore and is so spaced above said first surface that an upper surface on said head is adjacent to said second surface and flush therewith when the lower end of said shank is flush with said bottom surface.

In one embodiment of the invention, wherein the indicator can comprise a flat head nail, there are two bores opening to said location, at opposite sides of said plane and each inclined upwardly and away from said plane, in each of which the shank of the nail is slidably receivable. In another embodiment, said bore has its axis substantially contained in said plane; the indicator is substantially T-shaped and has an elongated bar-like head and a pin-like shank projecting downwardly from said head intermediate the ends thereof and slidably received in said bore; and the body has a hole therethrough that opens to opposite sides thereof and through which said head extends to have its opposite end portions respectively visible at opposite sides of the body, said first surface on the body being a bottom surface of said hole, and said hole defining a downwardly facing abutment surface on the body which is so spaced above said first surface that upward engagement of the head thereagainst prevents axial withdrawal of said shank from said bore and thus captivates the indicator.

BRIEF DESCRIPTION OF DRAWINGS

In the accompanying drawings, which illustrate two embodiments of the invention that are now regarded as preferred modes.

DETAILED DESCRIPTION OF PREFERRED EMBODIMENTS OF THE INVENTION

Figure 1:
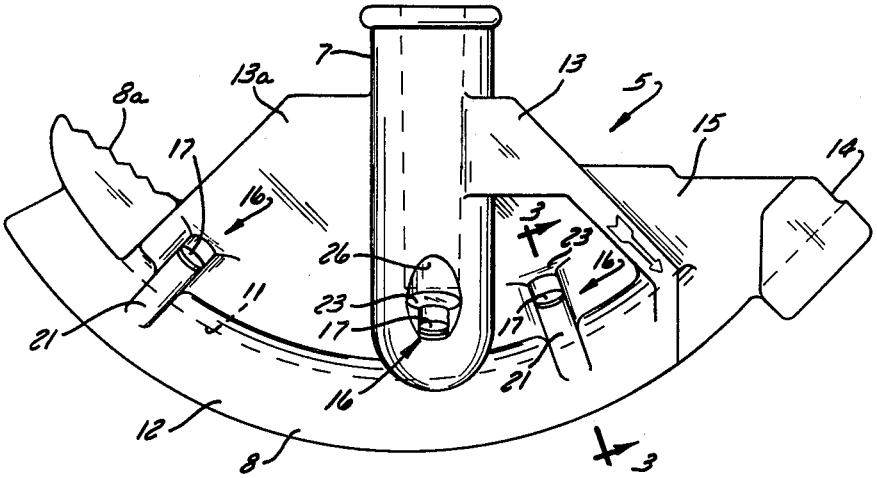
FIG. 1 is a view in side elevation of a bending tool (without its handle) that embodies the principles of this invention.
Figure 2:
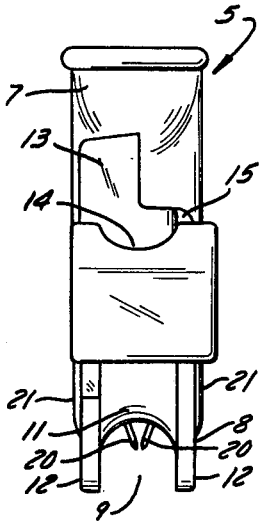
FIG. 2 is a front view of the bending tool shown in FIG. 1.

A bender for tubing, pipe, conduit and the like that embodies the principles of this invention comprises a sturdy body 5 that can be formed as a one-piece casting, together with an elongated shaft-like handle 6 which can be made of rigid steel tubing and which is removably received in an uowardly projecting socket-like handle supporting portion 7 of the body. The body 5 is elongated, extending substantial distances both forwardly and rearwardly from its handle supporting portion 7.

A bottom portion 8 of the body 5 comprises a shoe that is curved along its length to a convex arc. At its bottom the shoe 8 has a downwardly opening conduit-receiving groove 9 that extends along the full length of the shoe. The width and the depth of the groove 9 are equal to the diameter of tubing 10 to be bent by means of the tool, and the surface 11 of the inner half of the groove—which can be considered the bottom surface of the body 5—is concavely curved across its width on a radius substantially equal to that of the tubing. The flange-like bottom portions 12 of the shoe 8 that extend along it at opposite sides of its groove 9 can rockingly engage a floor or other surface as the shoe straddles a conduit 10 to be bent.

The groove 9 is symmetrical from side to side relative to a plane of symmetry that lies inside the body 5 and is normally vertical when the tool is in use. The handle supporting socket 7, which is substantially cylindrical, has its axis contained in this plane of symmetry, and the handle 6, which will normally be straight along its length, is received in a coaxial upwardly opening well in the socket 7.

The front end portion of the body 5 comprises a forwardly projecting upwardly opening hook 14. To support the high stresses that are imposed during a bending operation upon the handle socket 7 and the hook 14, those two portions of the bender body are connected by a front vertical web 15 which is also joined to the shoe 8. Upper portions of the web 15 can be substantially thickened, as at 13, to define reinforcing struts which extend between the handle socket 7 and front portions of the body 5. A rear vertical web 13*a* also connects the handle socket 7 with the rear portion of the shoe 8 and with a pedal 8*a* that overlies the rear end portion of the shoe. The pedal 8*a* has a transversely ridged upper surface upon which a user of the tool can place one foot, to hold the bottom flanges 12 of the shoe against the floor and to produce a bending force which supplements the force applied to the handle 6.

Figure 11:
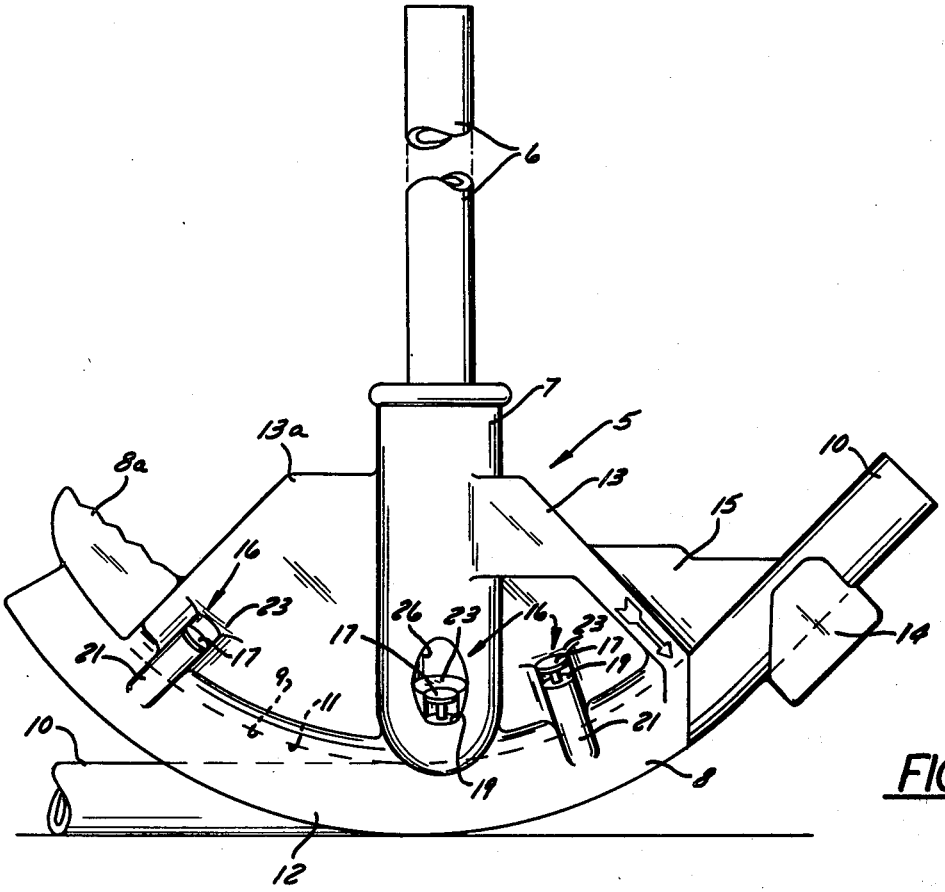
FIG. 11 is a view in side elevation of the bending tool shown in FIG. 1 in its operative engagement with a conduit being bent.
Figure 12:
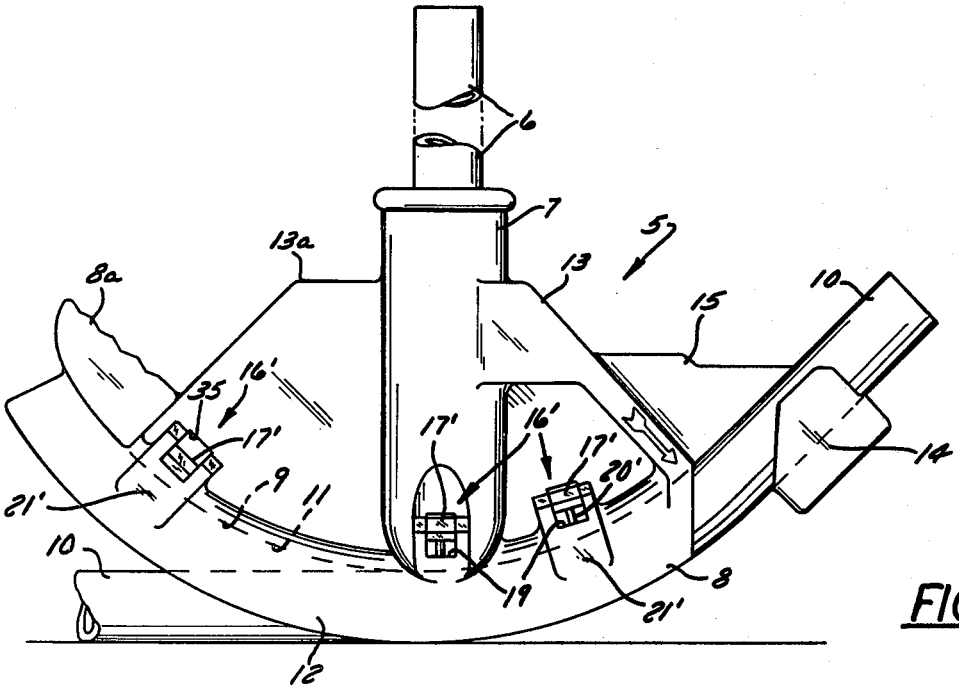
FIG. 12 is a view in side elevation of the bending tool shown in FIG. 6 in its operative engagement with a conduit being bent.

Bending a length of conduit 10 with the tool of this invention is generally conventional in that the hook 14 is engaged under the conduit 10 (FIGS. 11 and 12) and then, with the conduit otherwise supported by the floor, and with the shoe straddling the conduit, force is applied to the pedal 19 and the handle 6 in the direction to swing the handle rearward. This rocks the body on its flanges 12, raising the hook 14 which cooperates with the floor to bend the conduit around the shoe 8.

The arcuate bend that is imparted to the conduit or tubing as the tool body 5 is rocked on its flanges 12 has a radius substantially equal to that of the arc to which the shoe 8 is curved along its length. But the bend angle produced in the conduit is of course dependent upon the distance through which the handle 6 is swung rearward during the bending operation. This bend angle is the angle between the straight sections of conduit that are at opposite ends of the curve imparted to the conduit by means of the tool.

In general, the bend angle indicating means of this invention comprises a plurality of indicators 16, there being at least one such indicator for each of the bend angles to be indicated. Thus, in each of the two embodiments of the invention here illustrated there is an indicator 16 for signalling the attainment of each of the 22½°, 45° and 90° bend angles, these being the bend angles most frequently needed in practical work with a bending tool. It will be understood that the principles of the invention can be embodied in a tool that indicates additional or other selected bend angles.

The embodiment of the invention illustrated in FIGS. 1–5 and 11 has the advantage that it can be manufactured at low cost inasmuch as it can be sold simply as a one-piece body 5 adapted for cooperation with indicators 16 in the form of common flat-head nails supplied by the user. By way of example, the tool body 5 can be arranged for cooperation with lathing nails, which are cheap and readily available, have a length of about 1¼ in. that is convenient for this purpose, and have flat heads 17 that are relatively large and therefore readily visible.

For cooperation with the indicators 16 the tool body 5 has a straight bore 18 for each indicator, and each such bore opens downwardly to the bottom surface of the body and opens upwardly to a substantially upwardly facing surface 19 on the body. The lower end of each bore 18 is near the plane of symmetry, and hence is at the concavely curved inner surface 11 of the conduit receiving groove 9. Further, each bore 18 opens to the bottom surface of the body at the location therealong where a conduit 10 that is being bent comes into contact with that surface just as the conduit attains the bend angle signalled by the indicator 16 for the bore. Each bore 18 has a diameter to freely slidably receive the shank 20 of its indicator 16.

In the embodiment of the invention illustrated in FIGS. 1–5 and 11 there are two bores 18 at each of the designated angle locations, one at each side of the plane of symmetry and inclined at an acute upward and outward angle (e.g., 20°) to that plane. With this arrangement there can be an indicator 16 at each side of the body 5, so that the user of the tool, whether right-handed or left-handed, can observe an indicator without having to shift his head across the plane of symmetry.

Figure 3:
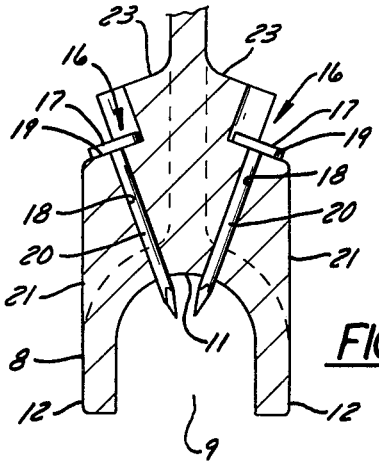
FIG. 3 is a fragmentary view in section, taken on the plane of the line 3—3 in FIG. 1 and showing indicators in place and in their non-signalling position.

At each bore 18 there can be a pad-like bulge 21 in the body casting that defines the upwardly facing surface 19 to which the bore opens at its upper end. This surface 19, which serves as an indicator supporting surface and is sometimes hereinafter designated a first upwardly facing surface, is preferably substantially flat and normal to the axis of its bore. The length of each bore 18—that is, the distance between the bottom body surface 11 and the indicator supporting surface 19—is shorter than the length of the shank 20 of the indicator. Hence, when an indicator 16 is received in a bore 18 and is not engaged by a workpiece, the head 17 of the indicator rests on the surface 19 to which that bore opens, and the lower end portion of the indicator shank 20 projects a distance below the bottom body surface 11, as shown in FIG. 3.

As a tube 10 or similar workpiece is being bent, it comes into engagement with the bottom end of the indicator 16 for a given bend angle as the bend in the workpiece nears that bend angle value; and with continued bending the workpiece raises the indicator 16 in its bore 18 until, when the workpiece arrives at exactly the bend angle designated by the indicator, the workpiece contacts the bottom body surface 11 at the location of the bore 18 for that indicator, and the bottom end of the shank 20 of the indicator is thereby held flush with the bottom surface 11 of the body 5. This relationship is illustrated in FIG. 4.

Figure 4:
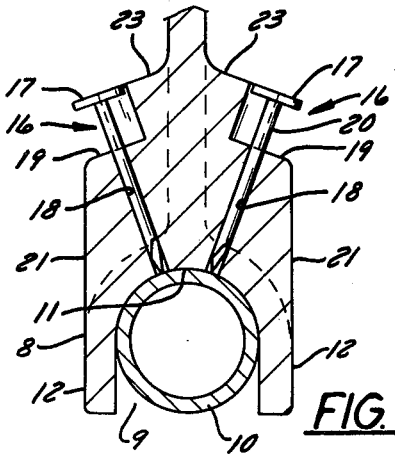
FIG. 4 is a view similar to FIG. 3 but showing the tool engaged with a conduit being bent and the indicators in their signalling positions.
Figure 5:
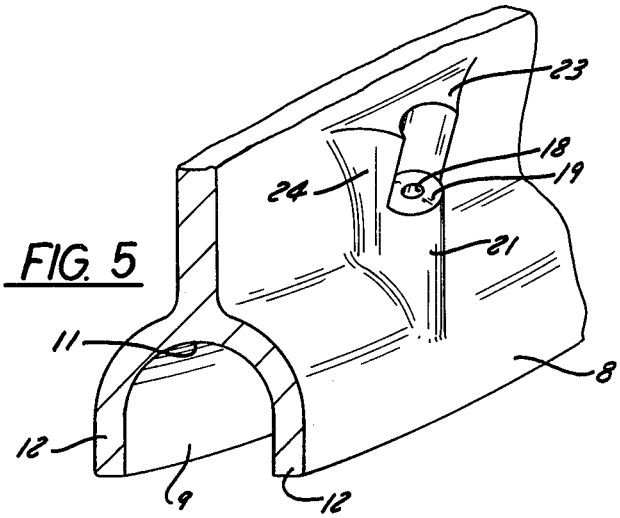
FIG. 5 is a fragmentary perspective view of the portion of the tool body that is in the general neighborhood of the line 3—3 in FIG. 1.
Figure 6:
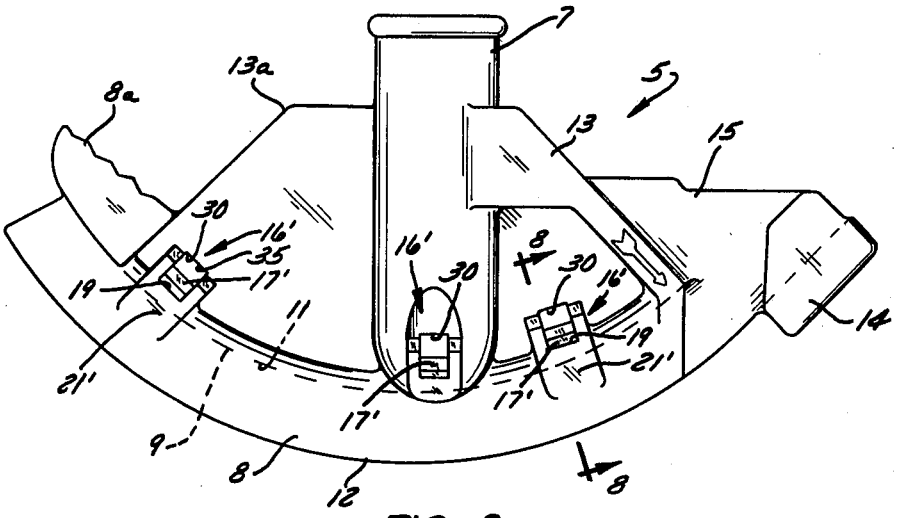
FIG. 6 is a view comparable to FIG. 1 but illustrating a modified embodiment of the bending tool of this invention.
Figure 7:
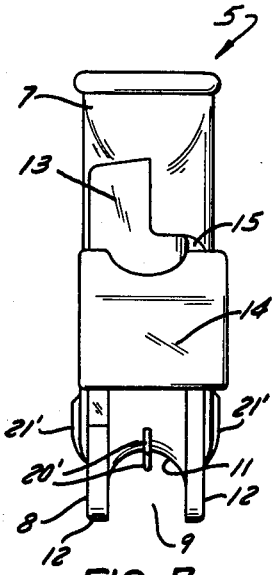
FIG. 7 is a front view of the bending tool shown in FIG. 6.
Figure 8:
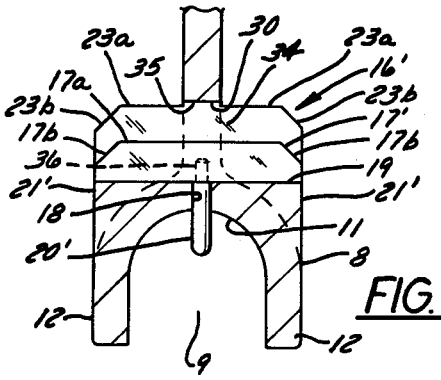
FIG. 8 is a fragmentary view in section, taken on the plane of the line 8—8 in FIG. 6 and showing the indicator in its non-signalling position.
Figure 9:
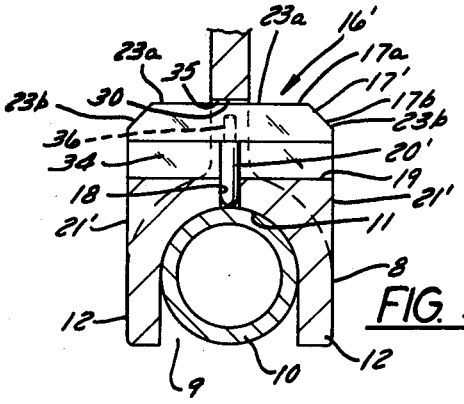
FIG. 9 is a view similar to FIG. 8 but showing the tool engaged with a conduit being bent and the indicator in its signalling position.

To signal the user of the tool that a designated bend angle has been attained, the indicator 16, in its fully raised position shown in FIG. 4, has the top surface of its head 17 flush with a substantially upwardly facing signalling surface 23 on the body that is spaced above the first surface 19. This second upwardly facing surface 23 can be formed on a second pad-like protuberance 24 on the body 5 that is so configured as to be in partially embracing relation to the indicator head 17 as the latter moves upwardly to its fully raised position, as best seen in FIG. 5. The signalling surface 23 is flat and normal to the axis of the bore 18, so that flush relationship of the head 17 to it is readily apparent.

It will be evident that a user may insert a nail or nails only into the bore or bores 18 for the particular bend angle desired, or may insert nails into all of the bores. In any case, the indicating arrangement is such that the indicator 16 that is of interest will be lowermost when the bend in the workpiece is near the desired bend angle and will thus be directly in the user's line of vision. Furthermore, the user will be alerted that he is coming close to the desired bend angle by the beginning of upward movement of the indicator 16 which designates that angle. When the head 17 of that indicator comes into flush relationship to the second surface 23, the user of course stops the application of bending force to the tool.

In the particular tool embodiment here shown, the axis of the handle socket 7 intersects the bottom body surface 11 at the location thereon that corresponds to the 45° bend angle. The indicator supporting surface 19 and the signalling surface 23 are in effect defined by recesses in the bottom portion of the handle socket 7, including a concavity 26 in that socket that extends upwardly from the signalling surface 23 and allows that surface to be easily seen from above the socket.

The embodiment of the invention illustrated in FIGS. 6–10 and 12, although a little more expensive than the mode described above, is more convenient to the user because it is self-contained. In this case there is only one bore 18 for each angle designated by an indicator 16', and each bore 18 has its axis contained in the plane of symmetry. Each bore 18 opens upwardly into a hole 30 that extends through the body 8 from side to side thereof, and the preferably flat bottom surface of this hole is the upwardly facing indicator supporting surface 19 to which the bore 18 opens upwardly.

In this case each of the indicators 16' is substantially T-shaped as viewed from either end of the shoe 8 (i.e., as in FIGS. 8 and 9), having a bar-like head 17' and a pin-like shank 20' that projects down from the middle of the head. The head 17' can be rectangular in outline as seen from above and from its ends, but as seen in elevation, it appears as a rectangle that has its upper corners bevelled away to provide a horizontal top surface **17*a* along most of its length and endwise outwardly and downwardly inclined upper surfaces 17*b* at its opposite ends, the purpose of which is explained hereinafter. The length of the bar-like head 17' is such that substantial end portions of it are readily visible at each side of the body 8**.

Figure 10:
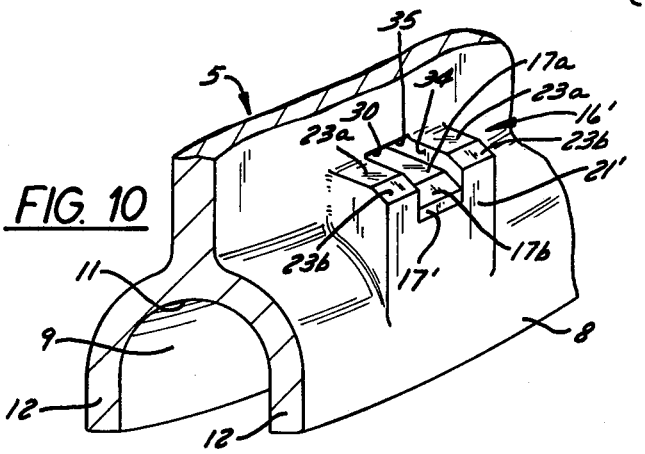
FIG. 10 is a fragmentary perspective view of the portion of the tool body that is in the general neighborhood of the line 8—8 in FIG. 6.

In this embodiment signalling surfaces for each indicator 16' are adjacent to laterally opposite sides of its bar-like head 17', formed on a pad-like protuberance 21' on each side of the body. Each such protuberance has an upwardly opening slot 34 therein in which the head 17' is vertically slidable and which forms an outwardly continuation of the hole 30 in the body, all as best seen in FIG. 10. There are coplanar upwardly facing signalling surfaces **23*a* at each side of the slot 34 with which the horizontal top surface 17*a* on the head comes into flush relationship when the indicator 16' is in its raised signalling position shown in FIG. 9; and there are also inclined signalling surfaces 23*b* with which the inclined surfaces 17*b* on the head 20' are in flush relationship in that position of the indicator. Because they are inclined to the user's line of sight, the cooperating oblique surfaces 17*b* and 23*b* make the signalling position more readily perceptible than it would be with only horizontal top surfaces 23*a* and 17*a***.

The hole 30 through the body 8 defines at its top a downwardly facing abutment surface 35 against which the indicator 16' is upwardly engageable to prevent it from rising to a position in which its shank 20' is withdrawn from the bore 18. Each indicator 16' is thus captivated in the body 8 and confined to limited up and down motion relative to it.

In this case the shank 20' of indicator 16' is a shouldered pin having a reduced diameter upper end portion 36 which is threaded or force fitted into a well in the bar-like head 17'. Each indicator is assembled with the body 8 by installing its bar-like head 17' in the hole 30 for it in the body and then inserting the shank 20' up through the communicating bore 18 in the body and securing its reduced diameter portion 36 in the well in the head.

It will be noted that each of the indicators 16' is in all respects well protected by the portions of the pad 21 that are adjacent to its head 17' and by the flanges 12 of the shoe, which guard its shank 20'.

From the foregoing description taken with the accompanying drawings it will be apparent that this invention provides an indicating tube bender having a one-piece body and movable indicators whereby a visual signal is presented when each of a plurality of predetermined bend angles has been attained during use of the tool. It will also be apparent that the indicating tube bender of this invention, although very inexpensive, is very compact, is not likely to be damaged by very rough handling, and is both easy to use and highly accurate.

What is claimed as the invention is:

1. A tool for bending conduit and the like, comprising an elongated body having an upwardly opening hook at a front end thereof, having a bottom surface against which conduit engaged by said hook is forced upwardly for bending and which extends rearwardly from said hook along a convex arc and is concavely curved from side to side symmetrically to an upright plane of symmetry, and having an upwardly projecting handle supporting portion that has its axis substantially contained in said plane, said tool being characterized by:

A. said body having (1) a supporting surface which faces substantially upwardly and is spaced above said bottom surface, and (2) a straight bore which extends substantially radially to said arc, opens upwardly to said supporting surface and opens downwardly to said bottom surface near said plane and at a location where conduit being bent by the tool comes into engagement with said bottom surface when it has been bent to a predetermined angle, said supporting surface and said bore being cooperable with an indicator that has a pin-like shank which is longer than said bore and is slidably receivable therein and has a head on an upper end of said shank which can rest on said supporting surface to support the indicator with a lower end portion of its shank projecting below said bottom surface so that engagement of the conduit with the lower portion of the shank causes the shank to slide upwardly within said bore; and B. said body further having thereon a signalling surface which faces substantially upward and which is spaced radially at a greater distance than said supporting surface from the axis of said bore and is so spaced above said supporting surface that a surface on said head is adjacent to said signalling surface and flush therewith when the lower end of said shank is flush with said bottom surface.

2. The tool of claim 1, adapted for cooperation with an indicator that comprises a flat head nail, further characterized by:

(1) said bore being one of two bores that open downwardly to said location, at opposite sides of said plane, each inclined upwardly and away from said plane, in each of which the shank of the nail is slidably receivable; and (2) each of said supporting surface and said signalling surface being one of a pair of substantially flat upwardly facing surfaces at opposite sides of said plane, each of which is substantially normal to the axis of the bore at its side of said plane.

3. The tool of claim 1 wherein said bore has its axis substantially contained in said plane of symmetry, further characterized by:

C. a substantially T-shaped indicator having (1) an elongated bar-like head and (2) a pin-like shank projecting downwardly from said head intermediate the ends thereof and slidably received in said bore; and D. said body having a hole therethrough that opens to opposite sides thereof and through which said head extends to have its opposite end portions respectively visible at the opposite sides of the body, (1) said supporting surface on the body being a bottom surface of said hole, and (2) said hole defining a downwardly facing abutment surface on the body which is so spaced above said supporting surface that upward engagement of the head thereagainst prevents axial withdrawal of said shank from said bore.

4. A tool for bending conduit and the like, comprising an elongated body having a conduit engaging hook at a front end thereof, having a convexly arcuate bottom surface against which conduit engaged by said hook is forced upward for bending and which is defined by a downwardly opening groove that extends rearward from said hook and is from side to side symmetrical to an upright plane of symmetry, and having an upwardly projecting handle supporting portion that has its axis contained in said plane, said tool being characterized by:

A. said body
  (1) having a hole therethrough which opens to opposite sides thereof and which defines
    (a) an upwardly facing indicator supporting surface and
    (b) a downwardly facing abutment surface, and
  (2) having a bore which has its axis contained in said plane and which
    (a) opens upwardly to said indicator supporting surface and
    (b) opens downwardly to said bottom surface at a location therealong where a conduit engages it when the conduit has been bent to a predetermined angle;

B. a substantially T-shaped indicator having
  (1) a bar-like head in said hole which projects to opposite sides of the body and
  (2) a shank projecting down from said head intermediate the ends thereof and lengthwise slidably received in said bore, said shank being longer than said bore to have its bottom end substantially below said bottom surface when said head rests on said indicator supporting surface and to be confined against displacement out of the bore by engagement of the head against said abutment surface; and C. said body having a signalling surface at each side thereof, located and oriented to be flush with upper surface portions on said head when the bottom end of said shank is flush with said bottom surface, as when a conduit being bent engages there against.

5. The tool of claim 4, further characterized by:
(1) said head having near each end thereof a top surface portion that faces obliquely upwardly and endwise outwardly and
(2) said body having signalling surfaces which are correspondingly inclined obliquely upwardly and outwardly.

6. The tool of claim 4 wherein said body has, at each side thereof, a sideward protuberance wherein there is an upwardly opening slot in which an end portion of said bar is slidable up and down and which separates a pair of signalling surfaces, one forward of said slot and one to the rear thereof.

* * * * *